US006840171B2

(12) United States Patent
Fuchs et al.

(10) Patent No.: US 6,840,171 B2
(45) Date of Patent: Jan. 11, 2005

(54) DEVICE FOR INSERTING A CONTINUOUS TAPE FOR A PRINTING OR COPYING SYSTEM COMPRISING MODULES

(75) Inventors: Werner Fuchs, Wörthsee (DE); Keil Wolfram, Steinhöring (DE); Stephan Schalke, München (DE); Ursula Stock, München (DE)

(73) Assignee: Océ Printing Systems GmbH, Poing (DE)

( * ) Notice: Subject to any disclaimer, the term of this patent is extended or adjusted under 35 U.S.C. 154(b) by 75 days.

(21) Appl. No.: 10/239,609

(22) PCT Filed: Apr. 5, 2001

(86) PCT No.: PCT/EP01/03904

§ 371 (c)(1),
(2), (4) Date: Feb. 4, 2003

(87) PCT Pub. No.: WO01/76873

PCT Pub. Date: Oct. 18, 2001

(65) Prior Publication Data

US 2004/0105711 A1 Jun. 3, 2004

(30) Foreign Application Priority Data

Apr. 7, 2000 (DE) ..... 100 17 371

(51) Int. Cl.[7] ..... B41F 13/54

(52) U.S. Cl. ..... 101/228; 101/181; 101/219; 101/225; 226/91; 226/92; 226/188

(58) Field of Search ..... 101/181, 219, 101/228, 225, 227, 172, 176; 226/187, 188, 91, 92

(56) References Cited

U.S. PATENT DOCUMENTS 4,509,733 A * 4/1985 Pflaum et al. ..... 270/41
4,598,850 A * 7/1986 Winterholler et al. ..... 226/92
4,750,659 A * 6/1988 Maier et al. ..... 226/92
5,152,471 A * 10/1992 Goerner ..... 242/530.4
5,816,152 A 10/1998 Nelgner et al.
6,038,973 A * 3/2000 Marmin ..... 101/225

FOREIGN PATENT DOCUMENTS

| | | |
|---|---|---|
| DE | 2 241 127 | 3/1974 |
| DE | 25 32 168 | 2/1977 |
| DE | 589 516 | 7/1977 |
| DE | 36 04 504 | 8/1987 |
| DE | 40 26 819 | 11/1991 |
| DE | G 94 09 390.3 | 10/1994 |
| DE | 198 01 317 | 8/1999 |
| EP | 0 152 737 | 8/1985 |
| EP | 0 449 287 | 3/1991 |
| JP | 60099655 A | 6/1985 |
| WO | WO 98/39691 | 11/1998 |

* cited by examiner

*Primary Examiner*—Andrew H. Hirshfeld
*Assistant Examiner*—Dave A. Ghatt
(74) *Attorney, Agent, or Firm*—Schiff Hardin LLP

(57) ABSTRACT

An apparatus and method is provided for threading a continuous web into a device arrangement having a first module and a second module connectable to and detachable from one another. First and second traction units are provided in the first and second modules. A gripper device grips a beginning section of the continuous web and is detachable to the traction units. The continuous web is pulled with the assistance of the gripper device from an input section to an output section of the respective module given movement of the traction units. A connector device connects the two traction units of the two modules to each other.

51 Claims, 9 Drawing Sheets

DEVICE FOR INSERTING A CONTINUOUS TAPE FOR A PRINTING OR COPYING SYSTEM COMPRISING MODULES

BACKGROUND OF THE INVENTION

The invention is directed to an apparatus for threading a continuous web, whereby a gripper device transports the beginning section of the continuous web from an input section for the continuous web up to an output section. The invention is also directed to a printer or copier system as well as to a module. Further, the invention is directed to a combined monitoring device.

DE-A 198 01 317 of the same assignee discloses an apparatus for introducing continuous stock recording media into electrographic printer or copier devices. This document is incorporated by reference as a source of disclosure for the present patent application. The assistance of such an apparatus makes it possible to automatically thread a continuous web through the printer machine before the beginning of a printing process. The operating ease is enhanced in this way and the economic feasibility of the printing machine is improved.

EP-A-0 152 737 discloses a draw-in device for drawing a paper web to be printed into a printing machine. In this printing machine, the traction means for drawing the paper web in has a common path (A) and either an upper path (B) or a lower path (C). The traction means is connected at two shunts to a traction means element for the upper path (B) or to a traction means element for the lower path (C).

High-performance printers and high-performance copiers that can handle extensive and complex print jobs or copier jobs are being employed to an increasing extent. Such systems are relatively large in volume, so that they are resolved into a number of machine modules that are easy to transport. The various modules are connected at the user=s premises to form the printing system or copier system. For example, WO 98/39691 of the same assignee discloses such high-performance printer systems or copier systems. This document is introduced by reference into the disclosure of the present application.

Another advantage of a modular concept wherein, for example, a printing system is divided into a printer module and a fixing module is the enhanced flexibility. Thus, an existing printer module can be combined with various types of fixing modules, whereby a prerequisite therefor is a defined, common interface. In a further development of the modular concept, modules processing further recording media can also be utilized that can be versatilely combined with further modules.

FP-60-99655 A with Abstract discloses an apparatus for drawing a continuous paper web in, whereby this continuous paper web is pulled through a plurality of successively arranged device modules. Each device module has its own traction means that circulates within the module. When the continuous web is conducted through a plurality of modules, the beginning section of the paper web is handed over to the traction means of the next module at the boundaries of the respective module.

SUMMARY OF THE INVENTION

An object of the invention is to specify an apparatus for threading a continuous web that is constructed in a simple way and is simple to handle and that works with high operating dependability.

According to the present invention, an apparatus and method are provided for threading a continuous web into a device arrangement having a first module and at least one second module connectable to and detachable from one another at an interface and which are successively traversed by the continuous web. Respective first and second traction units with corresponding drive units are provided in the first and second modules. The gripper device grips a beginning section of the continuous web and is attachable to the traction units, the continuous web being pulled with the assistance of the gripper device from an input section to an output section of the respective module given movement of the traction units. A connector device is provided with which the traction units of the two modules residing opposite one another at the interface are connectable to and detachable from one another. The gripper device transports a beginning section of the continuous web from the input section of the first module up to the output section of the second module in the connected condition of the traction units.

DESCRIPTION OF THE PREFFERED EMBODIMENTS

Figure 1:
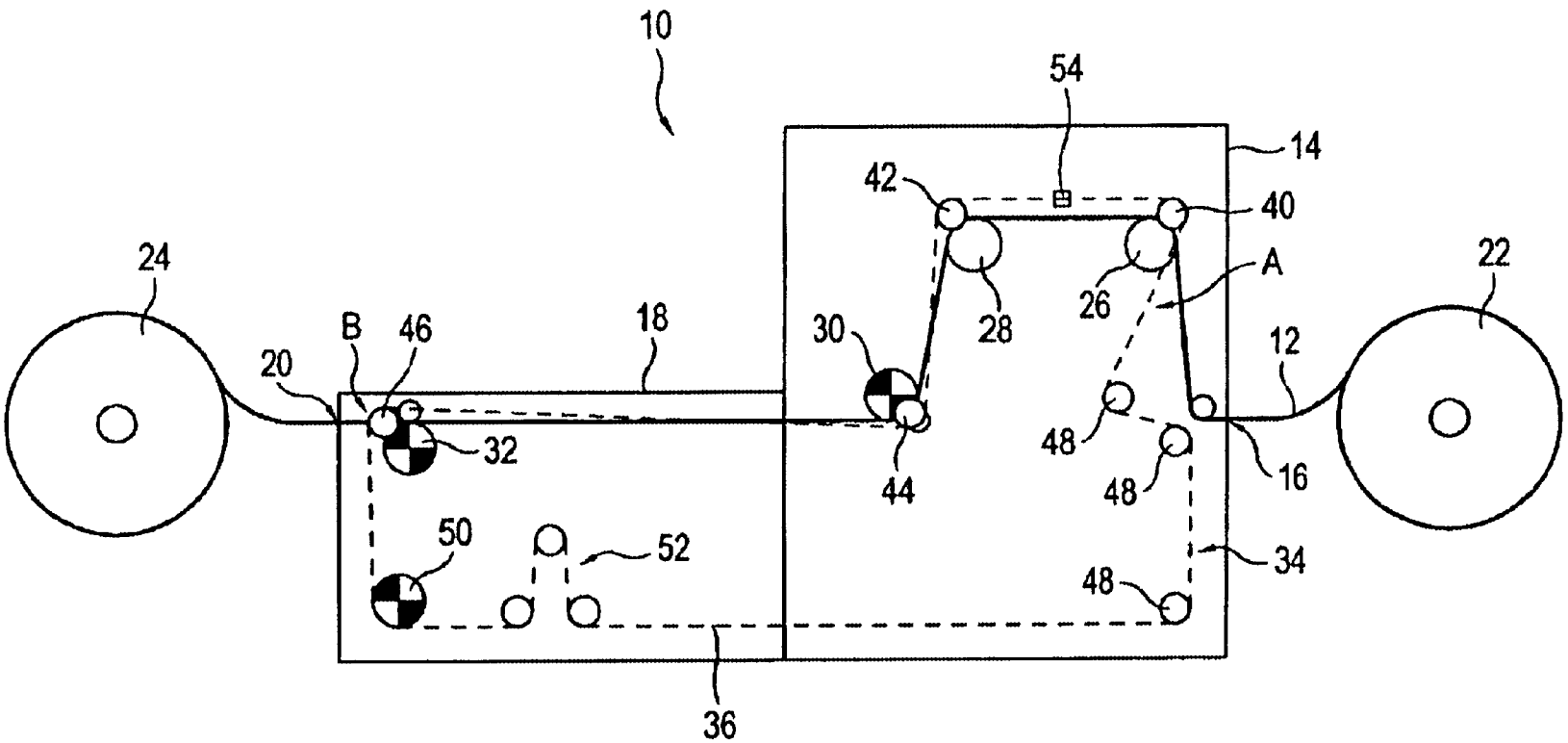
FIG.1 (PRIOR ART)
FIG. 1 is a schematic illustration of a printing system with a known introduction device for introducing a continuous web.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

According to the disclosed system, a traction unit is provided in each module, the assistance of the traction units making it possible to transport a gripper device for gripping a beginning section of the continuous web from an input section up to an output section of the respective module. The two traction means reside opposite one another at the interface between the two modules. A separable connecting device connects the two traction units, so that a combined through traction unit for both modules is created in the connected condition of the traction unit, and the gripper device can transport the beginning section of the continuous web from the input section of the first module up to the output section of the second module. The two traction units can in turn be detached from one another with the assistance of the connecting device, so that the two modules can be transported to a different location separately from one another. An apparatus is thus provided that allows an automatic threading of a continuous web through two or more modules. The apparatus is simply constructed and requires uncomplicated handling. When more than two modules are connected to one another, then a plurality of connecting devices that connect the respective traction units in the modules to one another are to be utilized at the module boundaries for creating a through traction units.

Another aspect is directed to a printer or copier system that is equipped with the described, modularly constructed threading apparatus.

According to a further aspect, a module is recited as part of a printer or copier system, whereby the module and a further module are connectable to one another and detachable from one another at an interface, comprising a traction unit with whose assistance a gripper device for gripping a beginning section of the continuous form can be transported from an input section up to an output section of the module, and comprising a part of a connecting device with which the traction units of the two modules residing opposite one another at the interface are connectable to one another and detachable from one another. When a plurality of modules are equipped with such a threading apparatus, then these modules can be connected to one another, as a result whereof an automatic threading of a continuous web through the various modules is enabled.

A further aspect is directed to a combined monitoring device, whereby the downward transgression of too low a tractive force of the traction unit and an upward transgression of too high a tractive force of the traction unit is signaled. With the assistance of combined monitoring device, the tension of the traction unit in the device arrangement comprised of a plurality of modules can also be regulated in one exemplary embodiment. The combined monitoring device contains a first tensing device and a second tensing device that are respectively charged by spring powers in the direction of the axis of the traction unit. When a specific tractive force of the traction unit is downwardly transgressed, the one tensing device is moved out of a limit position; when the tractive force of the traction unit is upwardly transgressed, the other tensing device is moved out of a limit position. A position sensor detects the movement of the tensing devices out of the limit positions and generates signals, whereupon the drive units for the traction units can be deactivated.

An exemplary embodiment of a known printing system as well as an exemplary embodiment with an apparatus is explained below.

FIG. 1 shows a schematic side view of a printing system referenced 10 overall that prints a continuous web 12. This printing system is equipped with a traditional device for threading the continuous web 12 and is disclosed by DE-A 198 01 317 of the same assignee. Various components that are also significant for the present system are explained on the basis of this known printing system. The problem for the present system is also illustrated.

The printing system 10 has a printer module 14 with integrated paper input 16 as well as a fixing module 18 with paper output 20. A supply reel 22 for the continuous web 12 is arranged preceding the paper input 16, this being generally a paper web and being rotatably seated in a preprocessing device (not shown). A stack of a fan-fold web can also be offered as a supply for the continuous web 12 instead of the supply reel 22.

As viewed in a transport direction of the continuous web 12, a take-up reel 24 that is seated in a post-processing unit (not shown) is provided following the paper output 20. Instead of the take-up reel 24, a finishing unit can also be connected to the paper output 20, this, for example, further-processing the continuous web 12 by cutting.

Two deflection drums 26 and 28 as well as a paper drive 30 are arranged in the printer module 14. Further, a printing device is provided in the printer module 14, but this is not shown for the sake of clarity. The fixing unit (not shown) as well as a driven haul-off 32 are arranged in the fixing module 18, the haul-off 32 conveying the continuous web 12 through the printing device 10 in common with the paper drive 30.

An insertion device—schematically referenced with 34—is also provided in the printing system, the continuous web 12 being automatically introduced into the entire printing system 10 therewith before being printed. For this purpose, the insertion device 34 employs two endless cables 36 arranged at both sides of the transport path of the continuous web 12, only one thereof being indicated by a dot-dash line in FIG. 1. The two cables 36 are conducted around a plurality of deflection arrangements 40, 42, 44 and 46 along the transport path of the continuous web 12 through the printing system 10. The deflection arrangements 40 and 42 are provided close to the deflection drums 26 and 28. The deflection arrangement 44 is arranged close to the paper drive 30, and the deflection arrangement is arranged close to the haul-off 32. Further, three deflection arrangements 48 are provided under the paper input 16, these tensing the cables 36 in the region of the paper input 16 and supplying them to the first deflection arrangement 40. The cable drive 50 of the insertion device 34, which can be driven both in a forward as well as in a reverse rotational sense, is arranged under the paper output 20. A cable tenser 52 that pre-stresses the two cables 36 independently of one another is provided between the cable drive 50 and the lower deflection arrangements 48.

Further, the insertion device 34 has a gripper device 54 proceeding transverse to the transport path of the continuous web 12, the gripper device 54 being secured to the cables 36 with connector elements. During the insertion of the continuous web, the gripper device 54 holds the leading edge thereof and is moved along the transport path by the cables 36 in order to transport the continuous web 12 through the printing system 10. The cable drive 50 can move the gripper device 54 between the position A close to the paper input 16 and the position B at the deflection arrangement 46. The cable 36 is continuous and has a length corresponding to the dot-dash line in FIG. 1.

When, given the printing system 10 of FIG. 1, the fixing module 18 is detached from the printer module 14, then the cables must be de-installed. Given a later joining of fixing module 18 and printer module 14, these cables 36 must be introduced anew and tensed. Since the printer module 14 and the fixing module 18 respectively contain a complex mechanism, the introduction of the cables 36 involves great expense. Moreover, the flexibility of the printing system 10 of FIG. 1 is limited, since the fixing module 18 and the printer module 14 are not modularly constructed in view of the insertion device 34.

Figure 2:
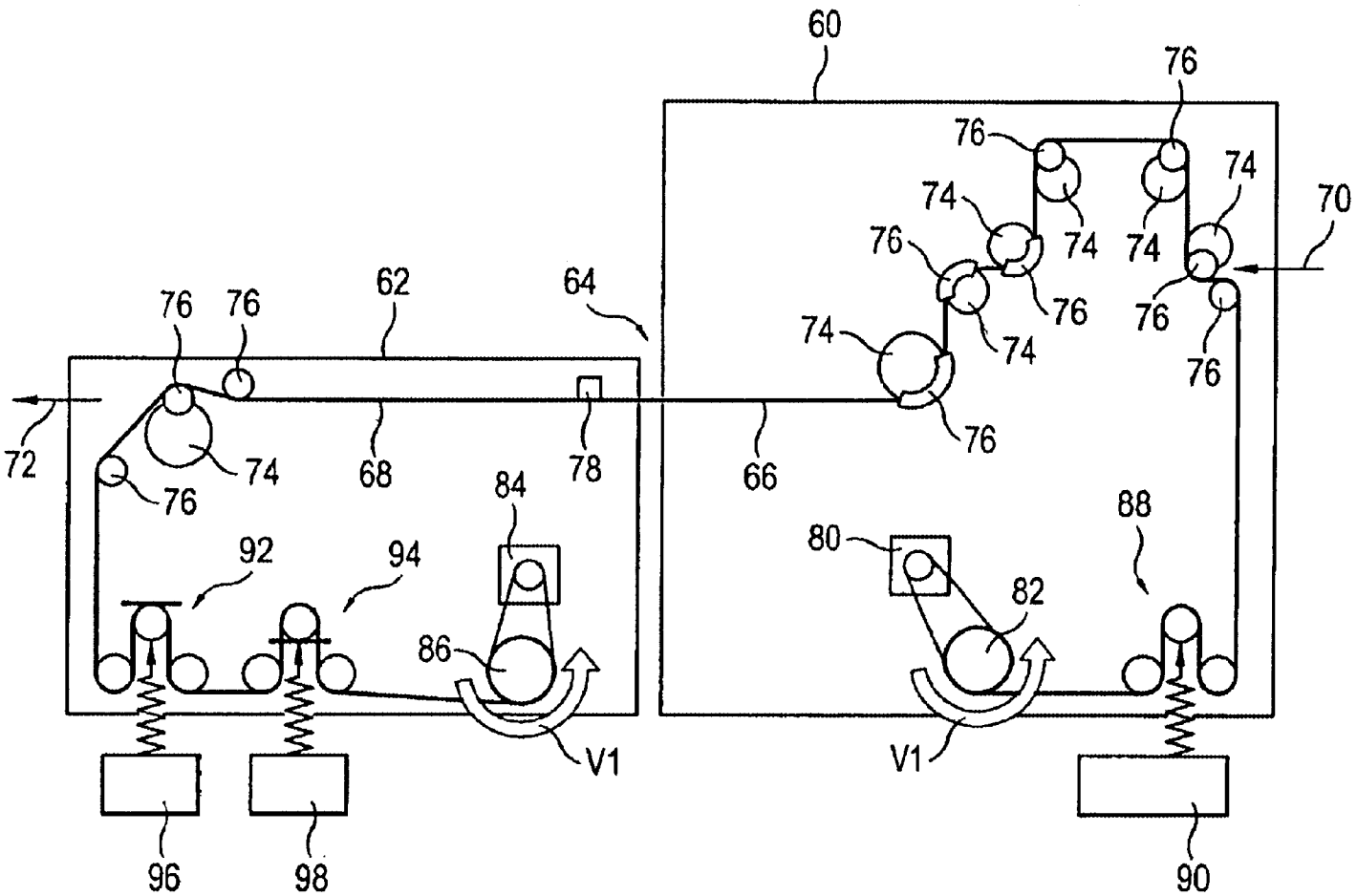
FIG. 2 is an arrangement of a printing system with a printer module and a fixing module having an apparatus for threading the continuous web.

FIG. 2 shows an exemplary embodiment. A printer module 60 of a high-performance printing system is detachably connected to a fixing module 62 at an interface 64. The two modules 60, 62 are transported to a customer separately from one another and are assembled thereat at the interface 64. As the respective traction unit 66 or 68, each module 60, 62 respectively contains two separate cables one each of which is are arranged at the opposite long sides of the transport path of the continuous web 12. For reasons of clarity, the transport path for the continuous web 12 is not shown in detail in FIG. 2; similar to FIG. 1, however, it proceeds from an input section 70 of the first module 60 up to an output section 72 of the second module 62 along transport rollers 74 for the continuous web 12, to which deflection elements 76 are allocated for guiding the cables 66, 68. A gripper device 78 can be moved from the input section 70 up to the output section 72 by the cables 66 and 68. As shall be described in greater detail later, the gripper device 78 grips a beginning section of the continuous web 12 and transports this beginning section from the input section 70 of the first module 60 up to the output section 72 of the second module 62.

As a drive unit, a first stepping motor 80 is arranged within the printer module 60, said first stepping motor 80 driving a first wind-up drum 82 onto which the two cables 66 are wound or from which the cables 66 are unwound.

In the same way, a second stepping motor 84 in the fixing module 62 is connected to a second wind-up drum 86 that winds up or unwinds the cables 68. The two stepping motors 80, 84 are preferably driven synchronously with one another, i.e. the wind-up or unwinding of the cables 66, 68 occurs synchronously. Alternatively, other motors that can be exactly positioned can also be employed, for example motors with incremental sensors that are driven incrementally.

The printer module 60 contains a tensing unit 88 with position sensors for each cable of the cable pair 66. In the parted condition of the modules 60, 52, this tensing unit 88 generates a cable tension for the cable 66. In the connected condition of the modules 60, 62, this tensing unit 88 generates the required cable tension for the cables 66, 68 (which are then connected) and also serves for the control of the stepping motors 80, 84 with the assistance of the control module 90.

A first monitoring unit 92 and a second monitoring unit 94 that are connected to control modules 96 or 98 are provided in the fixing module 62 for each of the two cables 68. The first monitoring unit 92 monitors the cable 68 for upward transgression of a maximum tensile stress. The second monitoring unit 94 monitors the cable 68 for downward transgression of a minimum tensile stress. The monitoring units 92, 94 respectively contain a position sensor, for example a micro switch, that monitors the position of a spring-loaded deflection drum around which the respective cable 68 is conducted. Given upward transgression of the maximum tensile stress or downward transgression of the minimum tensile stress, the position of the spring-loaded deflection roller changes, this being signaled to the control modules 96, 98 by the micro switch. With the assistance of the monitoring units 92, 94, an overload, for example due to a blockage of the cables 66, 68, or an under-load, for example when the continuous web or the cables 66, 68 tear, is recognized and signaled as an operating error. In the case of separated modules 60, 62, the monitoring units 92, 94 also offer the required cable tension for the cables 68 in the module 62.

It should also be mentioned that the control modules 90, 96 and 98 are preferably realized in software terms. A controller evaluates the supplied signals and generates the necessary displays or necessary control commands.

Figure 3:
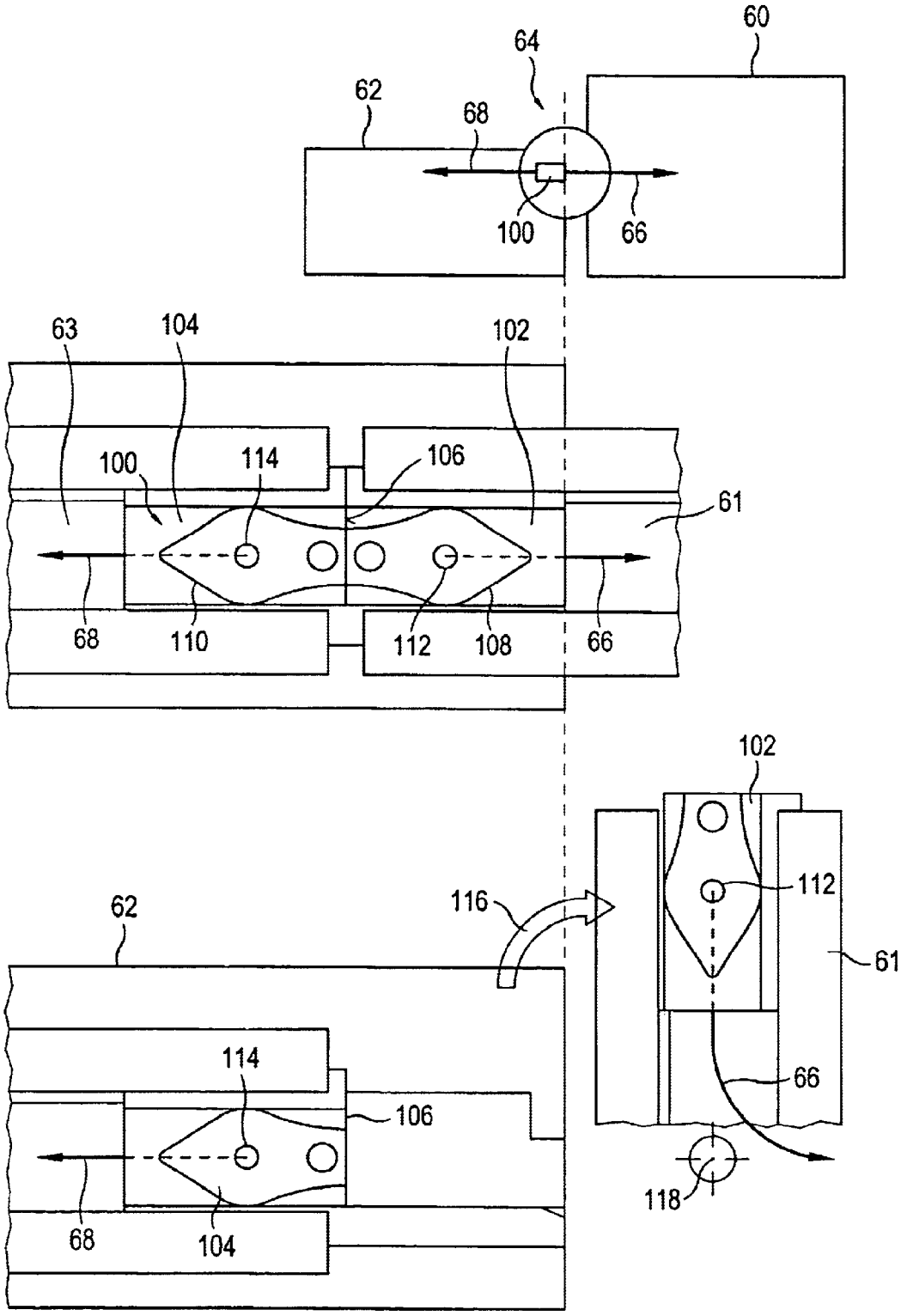
FIG. 3 is a schematic illustration of the interface between the two modules and the connecting device.

In a schematic drawing, FIG. 3 shows the interface 64 between the two modules 60, 62 in various operating phases. In the upper part of the Figure, the two modules 60, 62 reside opposite one another with the two respective cables 66, 68. The cables 66, 68 are connected to one another at a connector device 100. This connector device 100 also carries the gripper device 78, as shall be explained in greater detail later.

The structure of the connector device 100 can be seen in the middle part of FIG. 3. The connector device 100 contains a first crossbeam 102 and a second crossbeam 104 that can be connected to one another or detached from one another at a parting surface 106. The crossbeams 102, 104 have specifically shaped form elements 108, 110 at their ends that serve the purpose of guiding the connector device 100—that also carries the gripper device 78 at the same time—jerk-free on its path through the two modules 60, 62. The two form elements 108, 110 can likewise be separated at the parting surface 106. It must be pointed out that the gripper device 78 can also be arranged separate from the connector device 100.

The two cables 68 (only one can be seen in FIG. 3) of the fixing module are detachably fastened to the second crossbeam 104 in a fastening opening 114. Likewise, the two cables 66 of the printer module 60 are detachably fastened in fastening openings 112 of the first crossbeam 102. For example, the cables 66, 68 are hooked into the fastening openings 112, 114 with clamping sleeves secured to them. In their connected condition, the two crossbeams 102, 104 are connected to one another with fastener elements, for example screws (not shown).

The lower part of FIG. 3 shows the condition wherein the two modules 60, 62 are detached from one another. The two crossbeams 102, 104 of the connector device 100 are detached from one another at the parting line 106, for example by unscrewing the connecting screws. The first crossbeam 102 is accepted in a first mounting 61 and is swiveled up in the direction of the arrow 116 around a swiveling axis 118 within the printer module 60. In this way, the first crossbeam 102 is accepted within the module 60 such that it does not project beyond the limiting plane of the module 60 that faces toward the fixing module 62. The swivel around the swiveling axis occurs such that the cable 66 remains essentially length-neutral, i.e. no additional cable path is required as a result of the swivel motion. The second crossbeam 104 is also held in a second mounting 63 in the fixing module 62 such that it does not project beyond the limiting plane of the module 62 that faces toward the printer module 60. The cables 66, 68 remain anchored in the fastening holes 112, 114 and are kept under tension by cable tensioning devices in the respective modules 60, 62. In the detached condition of the modules 60, 62, the crossbeams 102, 104 are arrested in the respective mountings 61, 63.

The swiveling of the first crossbeam 102 has a further advantage. A possible, slight prescribed distance between the two modules 60, 62 can be bridged by the length of the swivel arm, this being preferably adjustable. As an alternative to a swivel motion, however, it is also possible in another exemplary embodiment to translationally move the two crossbeams 102, 104 toward one another. As warranted, a length store for the cables 66 or 68 is then required.

For connecting the two modules 60 and 62, the crossbeam 102 is swiveled around the swiveling axis 118 toward the second crossbeam 104 in the module 62 opposite the arrow direction 116. The two crossbeams 102 and 104 are subsequently connected to one another. After this, the arrests for the crossbeams 102, 104 are undone, so that the two connected crossbeams 102, 104, pulled by the cables 66, 68, can move freely through the two modules as connector device 100 with the gripper device 78.

For detaching the modules 60, 62 from one another, the connector device 100 is moved to the module boundary, so that the crossbeams 102, 104 are positioned relative to the mountings 61, 63. The crossbeams 102, 104 are arrested in these mountings 61, 63. Since the cables 66, 68 in each module 60, 62 are also under tensile stress in the separated condition, no loose ends of the traction elements derive at the interface. The cables 66, 68 thus assumed a defined, stable operating condition, as a result whereof operating errors are avoided.

The required handling for connecting the two crossbeams 102, 104 to one another and for releasing the two crossbeams 102, 104 from one another ensues such that corresponding actuation elements are actuated proceeding only from the side of the module 60. These actuation elements cannot be reached proceeding from the side of the module 62. The handling with the connector device 100 is facilitated in this way since an operator need only implement work steps proceeding from one module.

Figure 4:
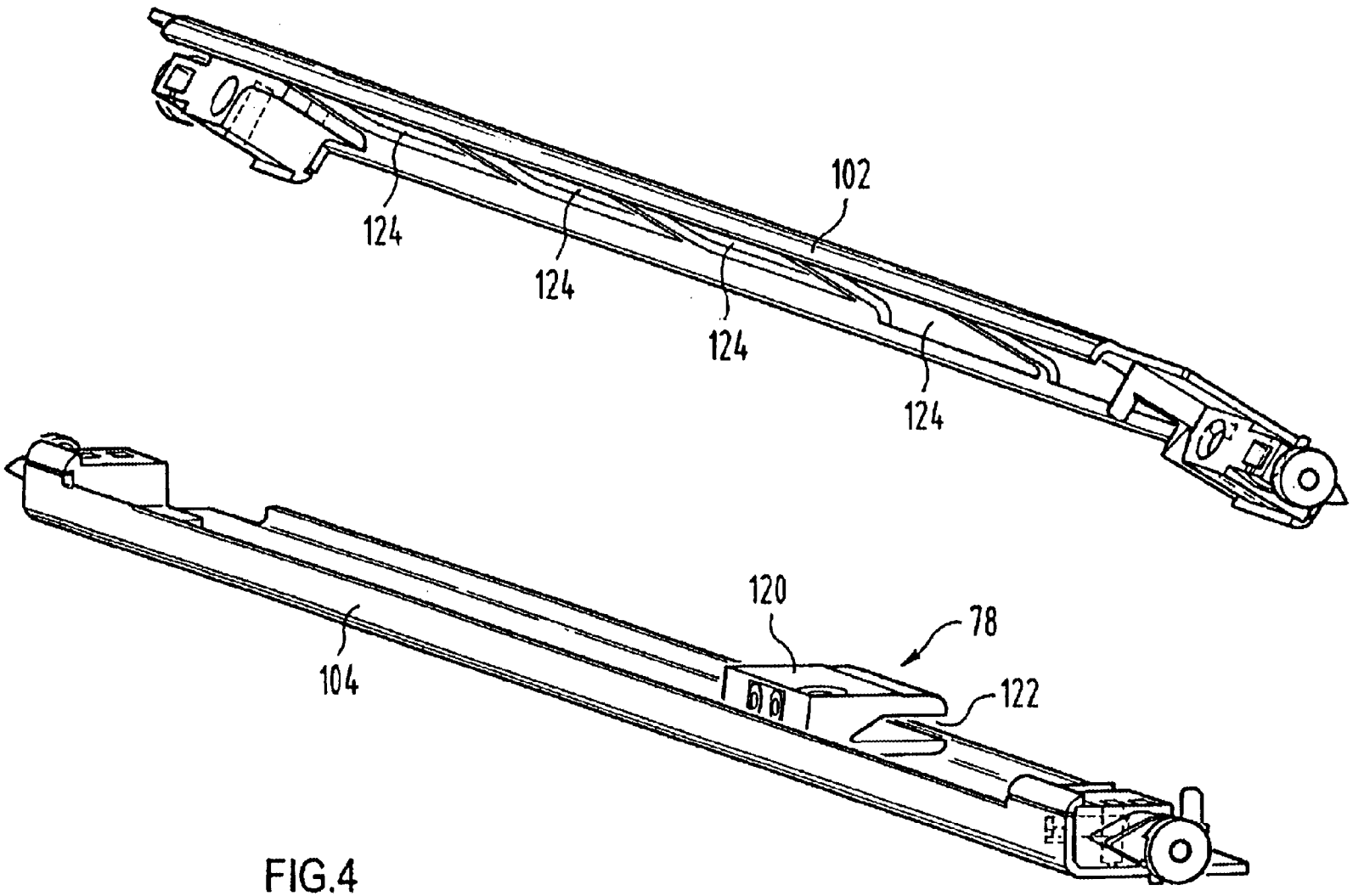
FIG. 4 is a perspective illustration of the connecting device with the two crossbeams.

FIG. 4 shows a perspective view of the two crossbeams 102 and 104 in a condition detached from one another. The second crossbeam 104 accepts a plurality of gripper elements 120, only one thereof being shown in FIG. 4. The totality of gripper elements 120 forms the gripper device 78, which is thus carried overall by the connector device 100. The gripper elements 120 fit in openings 124 in the first crossbeam 102. Each gripper element 120 has a mouth-shaped opening 122 for accepting the beginning section of the continuous web 12. This beginning section is held clamped in the gripper elements 120, so that it can be transported through the modules 60, 62.

Figure 5:
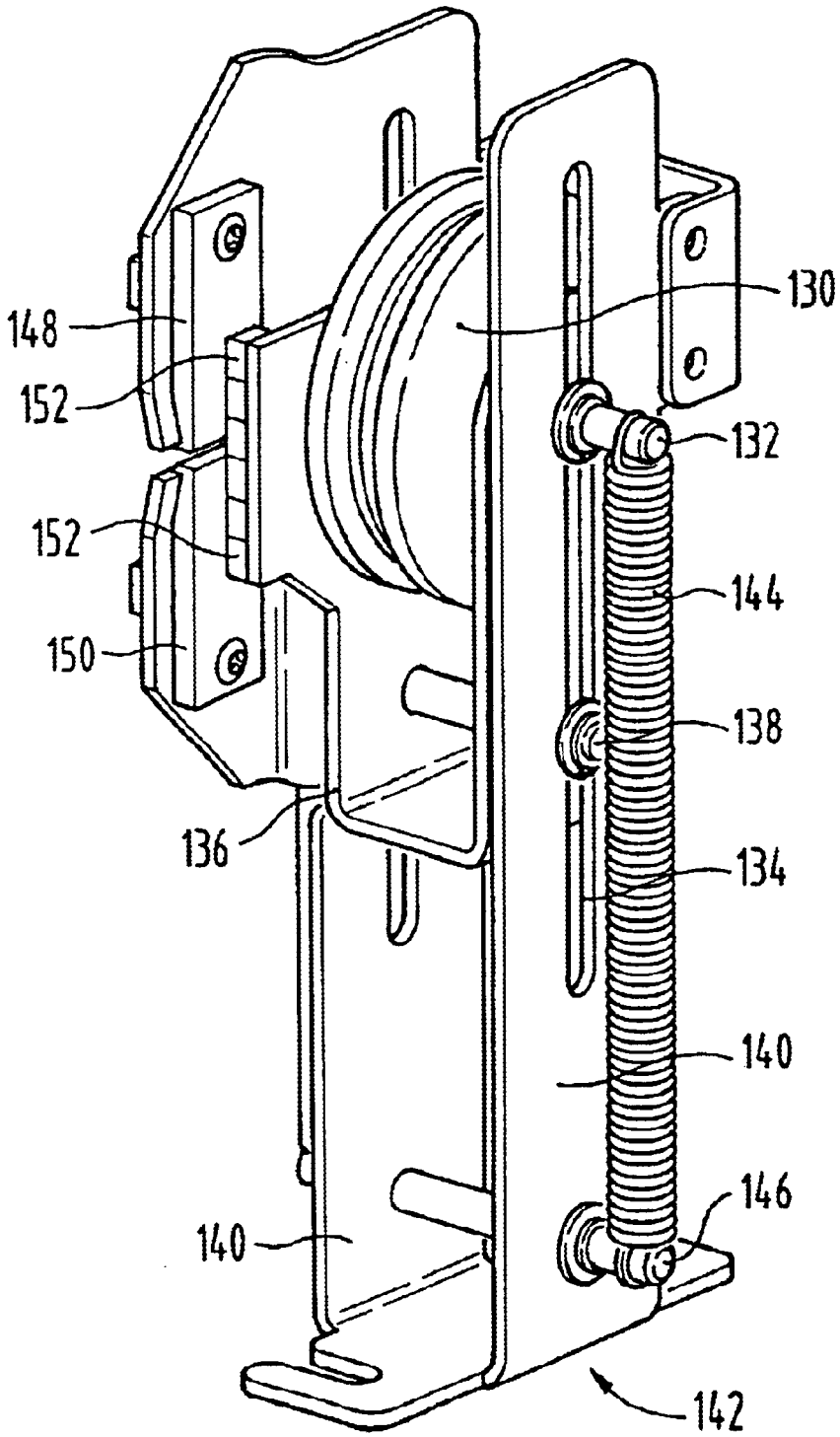
FIG. 5 is a perspective illustration of a tensing element with position detectors.

FIG. 5 shows an essential part of the tensing unit 88 (see FIG. 2). What is shown is a deflection roller 130 that guides the cable 66 in a wrap angle of approximately 180°. The deflection roller 130 has a roller axle 132 that is guided on a roller 138 in a longitudinal guide 134 displaceable along a longitudinal axis together with a movable carriage 136. The longitudinal guide 134 is let into legs 140 of a mounting 142. The roller axle 132 is pre-stressed in the direction of the axis 146 by tension springs 144. Alternatively, the pre-stress can also be generated by a compression spring that then correspondingly influences the deflection roller 130. Two Hall generators 148, 150 that interact with a plurality of permanent magnets (two thereof are referenced 152) are arranged on a leg 140. The permanent magnets 152 are moved together with the movable carriage 136 given excursion of the deflection roller 130. Together with the Hall generators 148, 150, the magnets 152 form position sensors that signal the excursion of the deflection roller 130. Preferably, the magnets 152 are arranged such that the Hall generators 148, 150 signal a minimum or a maximum excursion of the deflection roller 130. These signals proceed to the control module (see FIG. 2) and are evaluated thereat for the control of the stepping motors 80, 84. Instead of the arrangement comprising a plurality of permanent magnets 152 shown in FIG. 5, an arrangement having a single, elongated permanent magnet can also be employed, the effective magnetic field thereof influencing both Hall generators 148, 150 in the normal operating position of the deflection roller 130.

Figure 6:
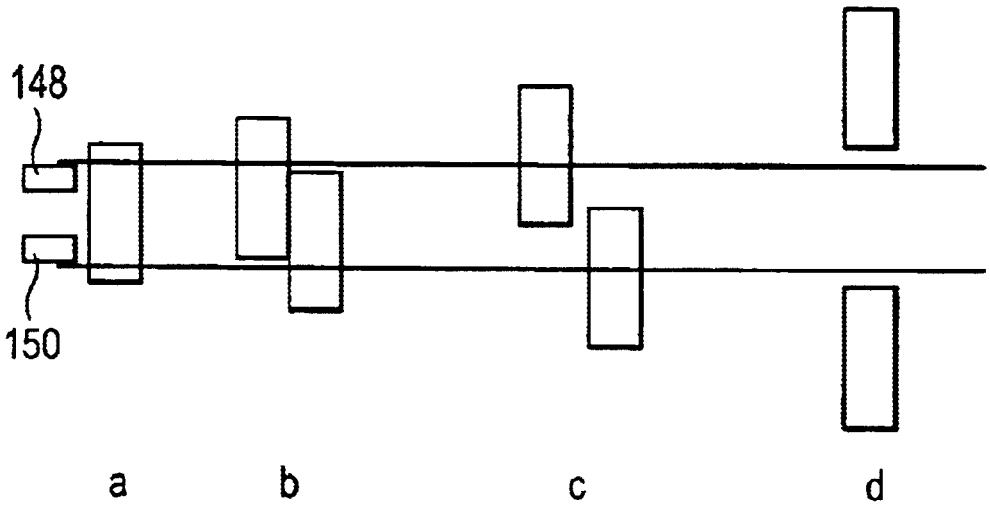
FIG. 6 is a schematic illustration of various states of the tensing elements.

FIG. 6 schematically shows four conditions of the deflection roller that are reproduced by the signals of the Hall generators 148, 150 given employment of an elongated permanent magnet. These signals are evaluated by the control module 90 (see FIG. 3), which in turn has a controlling influence on the stepping motors 80, 84.

In condition 'a', the deflection roller 130 and the carriage 136 with the permanent magnet is in a normal position wherein both Hall generators 148, 150 acquire the magnetic field of the permanent magnet. In condition 'b', the deflection roller 130 is deflected upward in a first position on one occasion and deflected downward in a second position on another occasion. Both positions are just still acquired at their limits by the Hall generators. In condition 'c', the respective excursion upward or downward is so great that only one Hall generator 148 or 150 still acquires the respective position. In condition 'd', the deflection roller 130 is deflected upward or downward so far that the respective acquisition range of the Hall generators 148 or, respectively, 150 is left.

In conditions 'a' and 'b', the signals output by the Hall generators 148, 150 produce no additional regulation of the stepping motors 80, 84. In condition 'c', the signals result therein that a regulating intervention is performed on the stepping motors 80, 84. In condition 'd', there is an error case that is signaled by the signals of the Hall generators.

In the example according to FIG. 2, a first monitoring unit 92 and a second monitoring unit 94 is provided in the fixing module 62 for each cable 66. Proper operation is monitored with the assistance of control modules 96 and 98 allocated to them. When a maximum tensile stress, for example a cable tension greater than 100 N, is detected, then a micro switch contained in the monitoring unit 92 is triggered. The control module 96 then switches the motors 84 and 80 off. When the second monitoring unit 94 detects the downward transgression of a minimum tensile stress, for example when the paper web tears, then a micro switch is likewise triggered. The allocated control module 98 then causes a stoppage of the motors 84, 80. For example, the motor stop is triggered given downward transgression of a cable tension less than or equal to 12 N. What is achieved in this way is that an improper operation does not lead to damage. When, for example, the gripper device 78 is blocked, then the cable tension rises rapidly. The shut-off of the motors 80, 84 prevents damage to the apparatus. When the tensile force in the cable is too low, for example given a torn cable or when one of the cables sags, then the forward transport of the cables 66 must likewise be shut off and an error message output, since no controlled guidance of the gripper device 78 is possible in this operating condition.

FIGS. 7 through 10 show an exemplary embodiment of a combined monitoring device 160 that unites the functions of the monitoring units 92, 94 in a single device. Identical parts are referenced the same.

Figure 7:
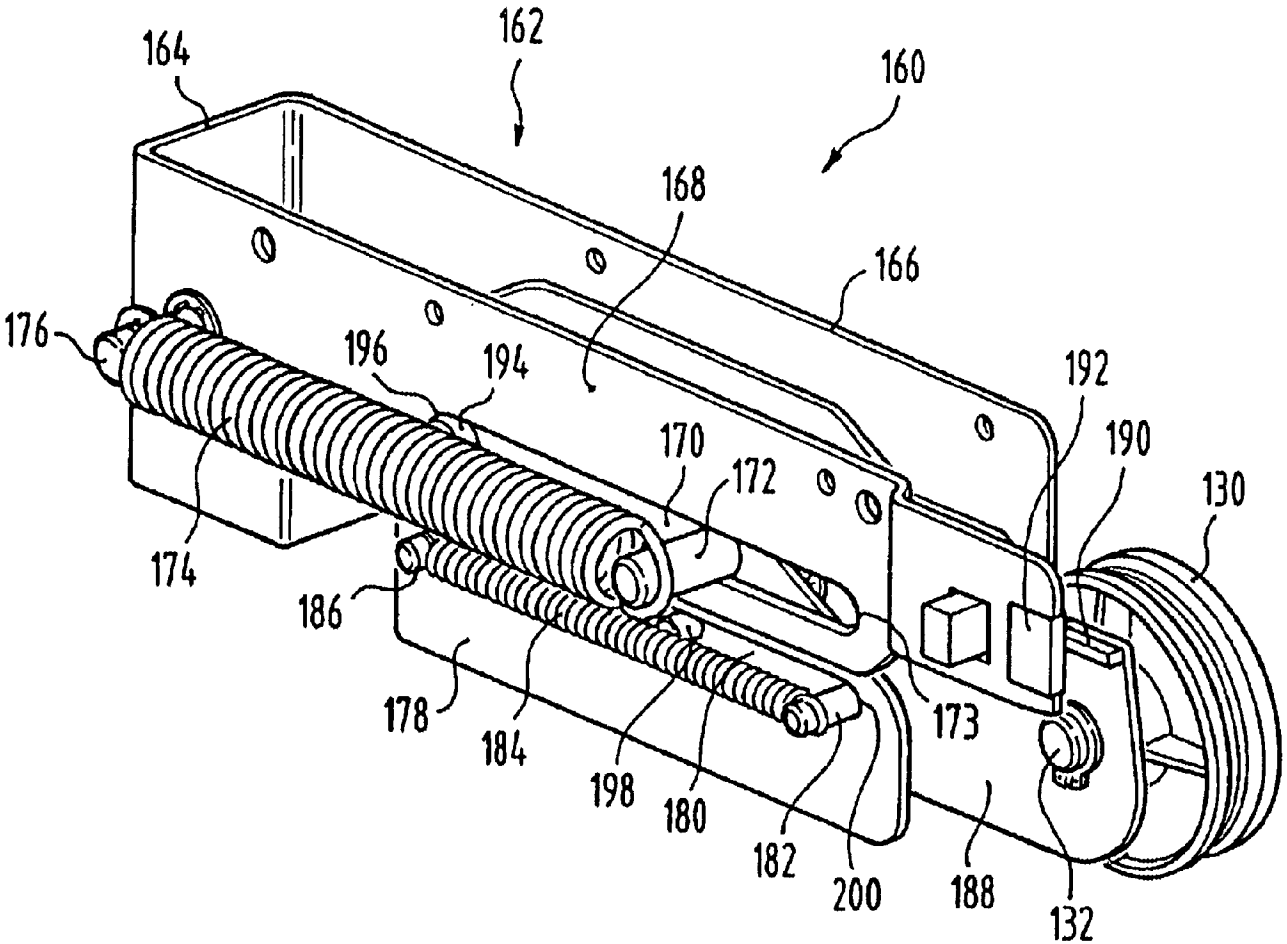
FIG. 7 is an illustration of a combined monitoring device with two tensing devices.

The monitoring device 160 shown in FIG. 7 has a U-shaped frame 162 with a base 164 and two legs 166, 168. These legs 166, 168 of the frame 162 contain oblong holes 170 at both sides in which respective pegs 172 are guided (only one peg 172 can be seen in FIG. 7) or a single, continuous peg 172 projects into both oblong holes 170. A first tension spring 174 attacks at the peg 172 or tension springs attack at both sides for a great cable force that pulls the peg 172 in the direction of a further peg 176 rigidly connected to the leg 168. The peg 172 is connected to a first carriage 178 designed U-shaped that serves as the first tensing device. The first carriage 178 has a respective oblong hole at its two legs in which a respective peg 182 or a continuous peg 182 is guided. At both legs, this peg 182 is preferably respectively connected to the end of a second tension spring 184 for low cable force that is rigidly connected via a further peg 186 to the first carriage 178. The peg 182 movable within the oblong hole 180 is rigidly connected to a second carriage 188 serving as the second tensing device that carries the deflection roller 130 on the shaft 132. An oblong hall magnet 190 is arranged at the second carriage 188. A Hall sensor 192 is arranged on the second leg 168 of the frame 162. Given an excursion motion of the deflection roller 130, the relative position of Hall magnet 190 to Hall sensor 192 is modified.

A guide peg 194 (only partly visible) that is rigidly connected to the first carriage 178 engages into the oblong hole 170. The guide peg 192 lies against a detent 196 and thus limits the movement of the first carriage 178 in the direction of the base 164. The second carriage 188 likewise carries a guide peg 198 that is guided in the oblong hole 180. Its movement toward the left is limited by a detent (not shown) in the oblong hole 180. A detent 200 [and [sic]] limits the longitudinal movement of the second carriage 188 relative to the first carriage 178. In the illustrated, normal operating position, the peg 182 lies against the detent 200. The guide peg 194 likewise lies against the detent 196. This means that the first tension spring 174 presses the first carriage 178 in the direction of the base 165 up to the detent 196; a cable (not shown) guided around the deflection roller 130 has such a high tensile force on the deflection roller 130 that the second carriage 188 experiences maximum excursion in the direction in FIG. 7 toward the right, and the peg 182 lies against the detent 200. The tensile force of the first tension spring 174 is greater in this condition than the tensile force of the cable that acts on the deflection roller 130. The tensile force of the second tension spring 184 is lower than the tensile force of the cable.

When the cable force with which the cable pulls toward the right at the deflection roller 130 in FIG. 7 falls below a specific value, for example 15 N, then the second tension spring 184 pulls the second carriage 188 and the deflection roller 130 in the direction of the base and thereby tenses the cable. When the cable force continues to drop, for example below 12 N, then the Hall magnet 190 on the second carriage 188 is moved so far in the direction of the base that it travels out of the coverage area of the Hall sensor 192. The Hall sensor 192 signals this condition, whereupon the motors 80, 84 are stopped and the transport of the gripper device 78 is interrupted. This condition can occur, for example, when the guided cable rips. When the cable force that acts on the deflection roller 130 rises above a specific value, for example 90 N, then the first tension spring 174 is tensed and the peg 172 experiences maximum excursion in the direction of the deflection roller 130 up to the detent 173, whereby the cable will yield. When the cable force continues to rise, for example above 100 N, then the Hall magnet 190 reflecting the position of the deflection roller 130 will move out of the coverage area of the Hall sensor toward the right, as a result whereof a corresponding signal is triggered that stops the motors 80, 84. The transport of the gripper device 78 is thereby stopped. This operating condition can occur when the gripper device has its transport blocked.

The position of the Hall sensor 192 relative to the Hall magnet 190 and the length of the Hall magnet 190 define the path length of the coverage area for the second carriage 188 relative to the stationary frame 162 and thus also define the cable path within which a proper operating condition is signaled. When the coverage area is left, then an error condition is signaled. This coverage area can be varied by changing the position of the Hall sensor 192 or by changing the length of the Hall magnet 190.

Figure 8:
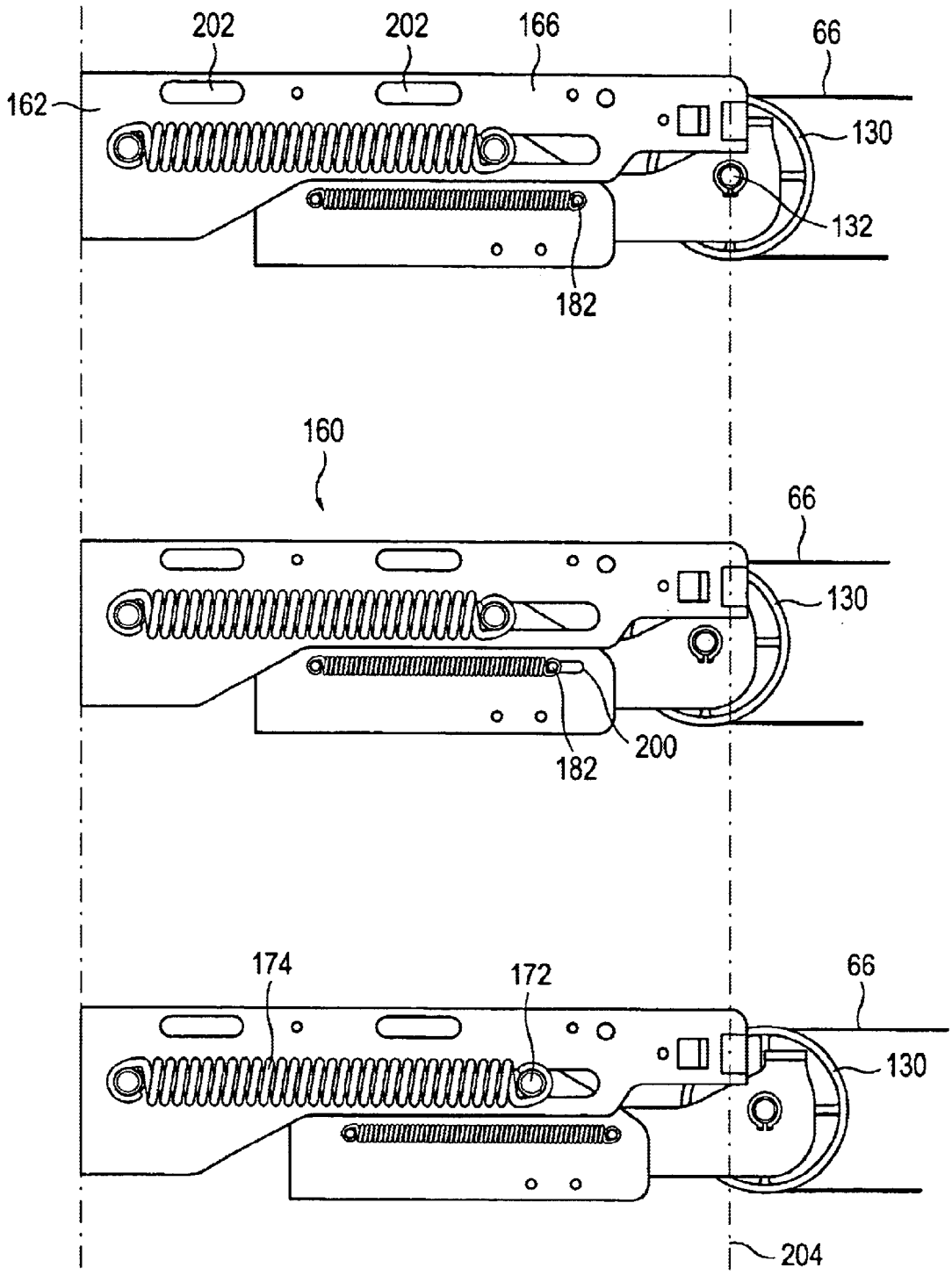
FIG. 8 shows three operating conditions of the combined monitoring device.

FIG. 8 shows various operating conditions of the monitoring unit 160. The leg 168 of the frame 162 contains oblong holes 202 in the direction of the axis of the cable 66. With the assistance of these oblong holes 202, the frame 162 can be mounted rigidly to the device in the module 62 (see FIG. 2), so that an adaptation to the cable length of the cable 66 can be achieved by a simple shifting of the frame 162. The normal operation of the monitoring unit 160 is shown in the upper part of FIG. 8. The excursion of the deflection roller 130 is illustrated on the basis of the reference axis 204. The cable tension in the cable 66 is too low in the middle part of the Figure; the deflection roller has deflected toward the left from the reference axis 204. The peg 182 no longer lies against the detent 200. The Hall magnet 190 leaves the coverage area of the Hall sensor 192, which signals this operating condition.

The cable tension of the cable 66 is too high in the lower part of FIG. 8. The deflection roller 130 has deflected toward the right from the reference axis 204. The tension spring 174 for high cable force is tensed and the peg 172 is deflected toward the right. The Hall magnet 190 leaves the coverage area of the Hall sensor 192 toward the right and the latter signals this error condition.

Figure 9:
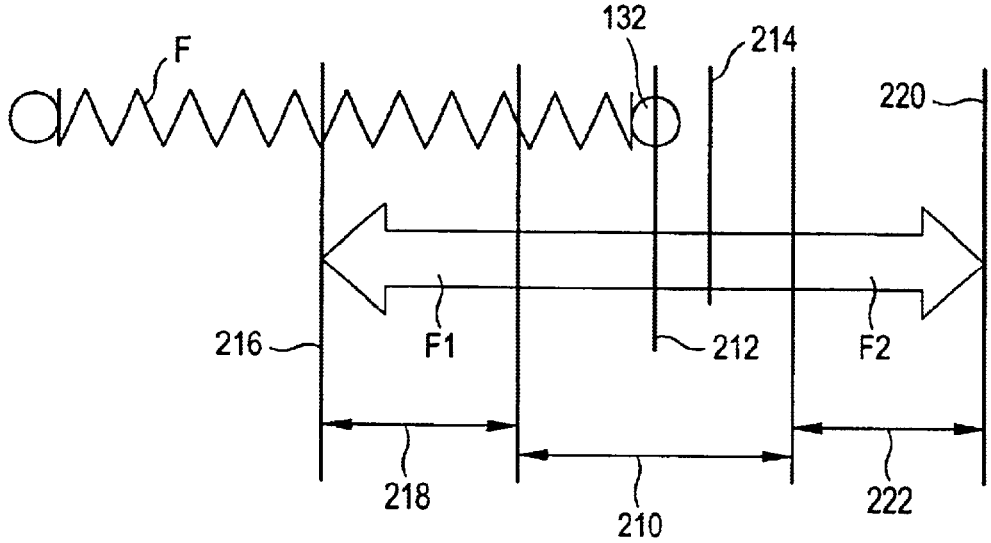
FIG. 9 shows a schematic illustration of the regulation of the cable tension with the assistance of the combined monitoring device.

The combined monitoring unit 160 according to FIGS. 7 and 8 can also additionally assume the function of the cable tensioning for the cable 66. For this purpose, it is necessary that at least one peg 182 or 194 does not lie against the allocated detent 200 or 196 within a regulating region for tensing the cable. FIG. 9 shows the regulation of the cable tension on the basis of a diagram. The shaft 132 of the deflection roller 130 can move back and forth within a regulating region 210, whereby a pre-defined cable tension is offered by the combined spring power of the first tension spring 174 and the second tension spring 184. The two springs are symbolically shown as one spring F in FIG. 9. The entered position 212 of the shaft 132 references a rated position within the regulating region 210. When the cable tension slackens, the shaft 132 moves toward the left in FIG. 9. This movement toward the left is effected by the second tension spring 184, whose spring path is defined by the arrow F1 between a first position 214 and a second position 216. The first position 214 is determined by the detent of the peg 182 at the detent 200. The second position 216 is defined by a detent of the guide peg 198 within the oblong hole 180 (not shown in FIG. 7). A path 218 is provided outside the regulating region 210 within which the motors 80, 84 (see FIG. 2) are to be shut off.

When the cable tension in the cable 66 becomes too great, then the shaft 132 of the deflection roller 130 in FIG. 9 is moved toward the right. When the position 214 is reached and overcome—the guide peg 182 lying against its detent 200 thereat B, then the first tension spring 174 is deflected. In FIG. 9, the spring path of this first tension spring 174 between the position 214 and the position 220 is referenced F2. The position 220 is defined by the peg 172 lying against the detent 173. A shut-off path 222 when leaving the regulating region 210 derives therefrom. The assembly composed of Hall magnet 190 and Hall sensor 192 as well as the additional control elements must be designed such that a dependable shut-off of the motors 80, 84 occurs within the path 222. In the normal condition, these motors 80, 84 are driven such that the shaft 132 remains within the regulating region 210. The position of the shaft 132 is thereby signaled by the arrangement of Hall magnet 190 and Hall sensor 192. The motors 80, 84 are then correspondingly driven within a control loop. In order to prevent an unnecessarily high cable tension in the cable 66, the rated position 212 of the shaft 132 of the deflection roller 130 should be selected such that the second tension spring 184 with the low spring power is at a relatively small distance, typically 5 through 10 mm, from the right detent, i.e. the distance between the positions 212 and 214 is to be correspondingly selected.

Figure 10:
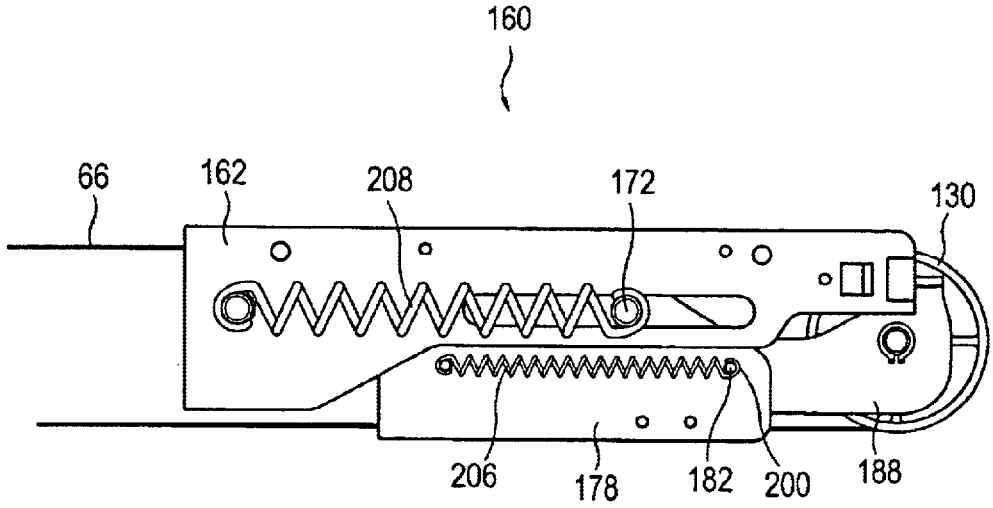
FIG. 10 illustrates the realization of the combined monitoring device upon employment of compression springs.

FIG. 10 schematically shows a modification wherein compression springs 206 and 208 are employed instead of the tension springs 174 and 184. In this modification, the cable 66 that is guided around the deflection roller 130 need not be threaded through into the space between second carriage 188 and deflection roller 130. Simpler handling upon insertion of the cable 66 is thus possible.

The first compression spring 206 for high cable force attacks at the second carriage given the example according to FIG. 10, so that the peg 182 lies against the detent 200 during normal operation. The second compression spring 208 for low cable force attacks at the peg 172, this being shown in its maximum left-hand position in FIG. 10. When the cable force in the cable 66 is reduced, then the deflection roller 130 and the peg 172 moves toward the right in FIG. 10. When the cable force becomes too high, then the deflection roller 130 and the peg 182 moves toward the left in FIG. 10. The dislocation of this position in the example of FIG. 7 is signaled by the arrangement comprised of Hall magnet 190 and Hall sensor 192.

Additionally, let it be pointed out that leaf springs or other spring elements can also be employed for realizing the spring tension for the two carriages.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

What is claimed is:

1. An apparatus for threading a continuous web, comprising:

a first module and at least one second module connectable to and detachable from one another at an interface and which are successively traversed by the continuous web;

respective first and second traction units with corresponding drive units being provided in the first and second modules;

a gripper device for gripping a beginning section of the continuous web and attachable to the traction units, the continuous web being pulled with the assistance of said gripper device from an input section to an output section of the respective module given movement of the traction units;

a connector device with which the traction units of the two modules residing opposite one another at the interface are connectable to and detachable from one another; and the gripper device transporting a beginning section of the continuous web from the input section of the first module up to the output section of the second module in the connected condition of the traction units.

2. The apparatus according to claim 1, wherein the first traction unit of the first module and the second traction unit of the second module each comprise two traction elements respectively arranged at opposite long sides of a transport path of the continuous web.

3. The apparatus according to claim 2 wherein one of a cable, a chain and a band is provided as each traction element.

4. The apparatus according to claim 1 wherein the connector device contains a first crossbeam and a second crossbeam connected to the first traction unit and to the second traction unit respectively, the two crossbeams are detached from one another in the detached condition of the modules, and the two crossbeams are connected to one another in the connected condition of the two modules.

5. The apparatus according to claim 4 wherein the respective crossbeams are accepted in the modules in the detached condition of the modules such that they do not project beyond a limiting plane of the modules facing toward one another.

6. The apparatus according to claim 4 wherein at least one of the crossbeams is seated swivellable around a swiveling axis, a swiveling of the crossbeam occurring substantially length-neutral for the respective traction unit.

7. The apparatus according to claim 4 wherein the respective crossbeams are arrested in their position in the detached condition of the modules.

8. The apparatus according to claim 4 wherein mechanical actuation elements corresponding to one another are actuated from a side of only one module for connecting the two crossbeams.

9. The apparatus according to claim 1 wherein the connector device holds the gripper device.

10. The apparatus according to claim 9 wherein the gripper device contains one or more gripper elements that clamp a beginning section of the continuous web.

11. The apparatus according to claim 1 wherein each module contains at least one tensing unit that keeps the respective traction unit under tension.

12. The apparatus according to claim 11 wherein the tensing unit contains a deflection roller around which the traction unit is conducted, and the deflection roller is seated displaceable along a longitudinal axis and is pre-stressed in a direction of the axis by a spring unit.

13. The apparatus according to claim 12 wherein the tensing unit contains a position sensor that acquires a position of the deflection roller relative to the longitudinal axis.

14. The apparatus according to claim 13 wherein the position sensor contains a first position sensor and a second position sensor that signal an excursion of the deflection roller.

15. The apparatus according to claim 14 wherein the first and the second position sensors comprise a Hall generator that interacts with at least one permanent magnet.

16. The apparatus according to claim 1 wherein the first module and the second module respectively contain a drive unit that winds the respective traction unit onto a wind-up reel or unwinds the traction unit from the wind-up reel.

17. The apparatus according to claim 16 wherein a stepping motor is employed as the respective drive unit.

18. The apparatus according to claim 17 wherein the drive units in the first and in the second modules are synchronously driven.

19. The apparatus according to claim 16 where both drive units are controlled by signals of the position sensors.

20. The apparatus according to claim 1 wherein a first monitoring unit monitors at least one of the traction units for upward transgression of a maximum tensile stress.

21. The apparatus according to claim 1 wherein a second monitoring device monitors at least one of the traction units for downward transgression of a minimum tensile stress.

22. The apparatus according to claim 21 wherein the first and the second monitoring units respectively contain a position sensor that monitors a position of a spring-loaded deflection roller around which the traction unit is conducted.

23. The apparatus according to claim 1 wherein a combined monitoring device is provided that monitors at least one of the traction units for upward transgression of a maximum tensile stress as well as for downward transgression of a minimum tensile stress.

24. The apparatus according to claim 23 wherein the combined monitoring device contains a frame in which a first tensing unit is arranged displaceable in its longitudinal axis against a force of a first spring;

the first tensing unit contains a second tensing unit seated displaceable in a longitudinal direction against a force of a second spring, said second tensing unit seating a deflection roller around which the traction unit is guided; and a position of the deflection roller is. determined by a position sensor that triggers an error signal given upward transgression of a prescribed limit position value.

25. The apparatus according to claim 24 wherein the force of the first spring is dimensioned in the normal operating condition such that the first tensing unit is held in a first limit position in stable fashion; and the force of the second tension spring is dimensioned such that the second tensing unit is held in a second limit position in stable fashion.

26. The apparatus according to claim 25 wherein the force of the first spring is considerably greater than a force of the traction unit acting on the deflection roller; and the force of the second spring is dimensioned such that it is considerably lower than the force of the traction unit acting on the deflection roller.

27. The apparatus according to claim 25 wherein the position sensor signals a departure from the limit positions of a first thrust unit or of a second thrust unit.

28. The apparatus according to claim 24 wherein the position sensor contains a Hall magnet and a Hall sensor.

29. The apparatus according to claim 28 wherein one component of the position sensor is arranged at a frame and the other component is arranged on the second tensing unit.

30. The apparatus according to claim 28 wherein the Hall sensor has a coverage area for the Hall magnet, and an error signal is triggered given departure from the coverage area.

31. The apparatus according to claim 23 wherein for tensing the traction unit, an actual position of the deflection roller is acquired, the deflection roller is regulated within a regulating region by driving drive units, and an error signal is generated given departure from the regulating region.

32. The apparatus according to claim 24 wherein a compression spring is respectively employed as the first and second springs.

33. The apparatus according to claim 1 wherein a displacement unit is provided at a frame with which the frame is displaceable relative to a rigid frame in order to adapt a combined monitoring unit to a length of the traction unit.

34. The apparatus according to claim 1 wherein the first module is one of a printer module and a copier module and the second module is a fixing module containing a fixing facility.

35. A printing or copying system, comprising:

a first module containing a printing device and at least a second module containing a fixing device connectable to and detachable from the first module at an interface;

a traction unit provided in each module and a gripper device for gripping a beginning section of a continuous web to be transported from an input section up to an output section of the respective module; and a connector device with which the traction units of both modules residing opposite one another at the interface are connectable to and detachable from one another so that in the connected condition of the traction units, the gripper device transports the beginning section of the continuous web from the input section of the first module up to the output section of the second module.

36. A printing or copying system module, comprising:

a connecting system connecting and detaching the module from a further module at an interface;

a traction unit arranged in the module with assistance of which a gripper device for gripping a beginning section of a continuous web is transported from an input section up to an output section of the module; and a connector device with which the traction unit of the module is connected and detached from a traction unit in the further module.

37. A module according to claim 36 including:

a monitor for monitoring a tension of the traction unit which transports the beginning section of the continuous web which is attached to the traction unit with the gripper device; and the monitor monitoring whether said tension exceeds a maximum tensile stress or falls below a minimum tensile stress.

38. The monitoring device according to claim 37 wherein a frame is provided in which a first tensing device is arranged displaceable on its longitudinal axis against a force of a first spring;

the first tensing device containing a second tensing device seated displaceable in the longitudinal direction against a force of a second spring said second tensing device seating a deflection roller around which the traction unit is guided; and a position of the deflection roller being determined by a position sensor that triggers an error signal given upward transgression of a prescribed limit position value.

39. The monitoring device according to claim 38 wherein the force of the first spring is dimensioned in a normal operating condition such that the first tensing device is held in a first limit position in stable fashion; and the force of the second tension spring is dimensioned such that the second tensing device is held in a second limit position in stable fashion.

40. The monitoring device according to claim 39 wherein the force of the first spring is considerably greater than the force of the traction unit acting on the deflection roller; and the force of the second spring is dimensioned such that it is considerably lower than the force of the traction unit acting on the deflection roller.

41. The monitoring device according to claim 40 wherein the position sensor signals a departure from the limit positions of the first thrust device or of the second thrust device.

42. The monitoring device according to claim 41 wherein the position sensor contains a Hall magnet and a Hall sensor.

43. The monitoring device according to claim 42 wherein the Hall sensor has a coverage area for the Hall magnet, and an error signal is triggered given departure from the coverage area.

44. The monitoring device according to claim 38 wherein one component of the position sensor is arranged at the frame and another component is arranged on the second tensing device.

45. The monitoring device according to claim 38 wherein for tensing the traction unit, an actual position of the deflection roller is acquired, the deflection roller is regulated within a regulating region by driving the drive units, and an error signal is generated given departure from the regulating region.

46. The monitoring device according to claim 38 wherein a compression spring is respectively employed as the first and the second spring.

47. The monitoring device according to claim 37 wherein a frame is displaceable relative to a rigid frame of the device in order to adjust a combined monitoring unit to a length of the traction unit.

48. An apparatus for threading a continuous web, comprising:

a first module and a second module connectable to and detachable from one another at an interface and which are successively traversed by the continuous web;

respective first and second traction units provided in the first and second modules;

a gripper device for gripping a beginning section of the continuous web and attachable to the traction units, the continuous web being pulled with the assistance of said gripper device from an input section to an output section of the respective module given movement of the traction units;

a connector device connected with the gripper device and with which the traction units of the two modules residing opposite one another at the interface are connectable to and detachable from one another; and the gripper device transporting a beginning section of the continuous web from the input section of the first module up to the output section of the second module in the connected condition of the traction units.

49. A method for threading a continuous web into a device comprising a first module and at least one second module connectable to and detachable from one another at an interface and which are to be successively traversed by the continuous web, comprising the steps of:

providing respective first and second traction units in the first and second modules;

attaching the first module to the second module, attaching the first traction unit to the second traction unit with a connector device, and providing a gripper device connected to the connected first and second traction units;

connecting a beginning section of the continuous web to the gripper device; and moving the connected first and second traction units so as to pull the continuous web from an input section of the first module up to an output section of the second module.

50. The method according to claim 49 including the step of providing the gripper device and the connector device together.

51. The method according to claim 49 including the step of providing a separate drive unit in the first module for driving the first traction unit and another drive unit in the second module for driving the second traction unit.

* * * * *